US005597299A

United States Patent [19]

Jon

[11] Patent Number: 5,597,299

[45] Date of Patent: Jan. 28, 1997

[54] IGNITION SAFETY DEVICE OF GAS LIGHTER

[76] Inventor: Jong K. Jon, 4-1104, Yoowonhongun Apt., Hongun 2-dong, Seodaemun-gu, Seoul, Rep. of Korea

[21] Appl. No.: 234,046

[22] Filed: Apr. 28, 1994

[30] Foreign Application Priority Data

May 24, 1993 [KR] Rep. of Korea ..... 93-8803
Mar. 15, 1994 [KR] Rep. of Korea ..... 94-5171

[51] Int. Cl.[6] ..... F23D 11/36

[52] U.S. Cl. ..... 431/153; 431/277

[58] Field of Search ..... 431/153, 277

[56] References Cited

U.S. PATENT DOCUMENTS 4,717,335 1/1988 Loveless ..... 431/153
4,822,276 4/1989 Bisbee ..... 431/153
5,085,578 2/1992 Hunter ..... 431/153
5,236,351 8/1993 Tien ..... 431/277

*Primary Examiner*—Carl D. Price
*Attorney, Agent, or Firm*—Morgan & Finnegan, L.L.P.

[57] ABSTRACT

An ignition safety device of a gas lighter. In an embodiment, the safety device comprises at least one protrusion provided on the ignition roller unit of the lighter. The protrusion may be formed on the knurled outer surface of the rolling shaft or on the rolling flanges of the roller unit. In another embodiment, the safety device comprises a transverse rod extending from one rolling flange toward the other rolling flange such that it crosses over the rolling shaft between the rolling flanges. One end of the transverse rod is connected to the inside surface of the one flange but the other end of the transverse rod is spaced apart from the inside surface of the other flange. The safety device provided on the ignition roller unit prevents more rotation of the rolling shaft when the rolling shaft has been rotated at a predetermined rotating angle and ignited the gas out of the nozzle. In order to return the ignition roller unit to a rotatable position, the roller unit is simply rotated in reverse direction such that the safety device is sufficiently spaced apart from the flint support column of the lighter body.

14 Claims, 3 Drawing Sheets

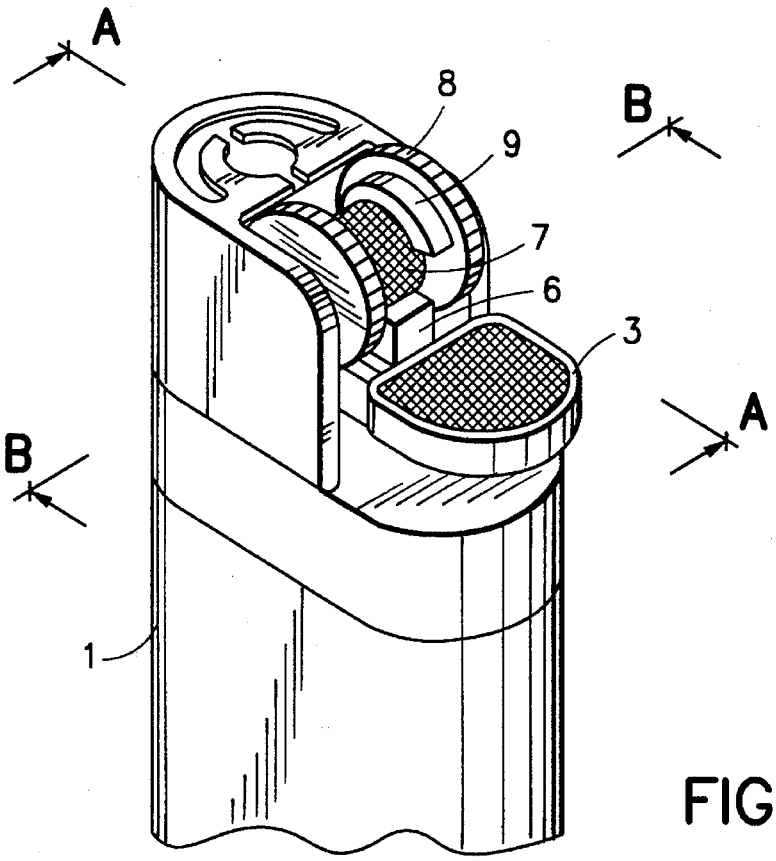
FIG. 1
FIG. 2
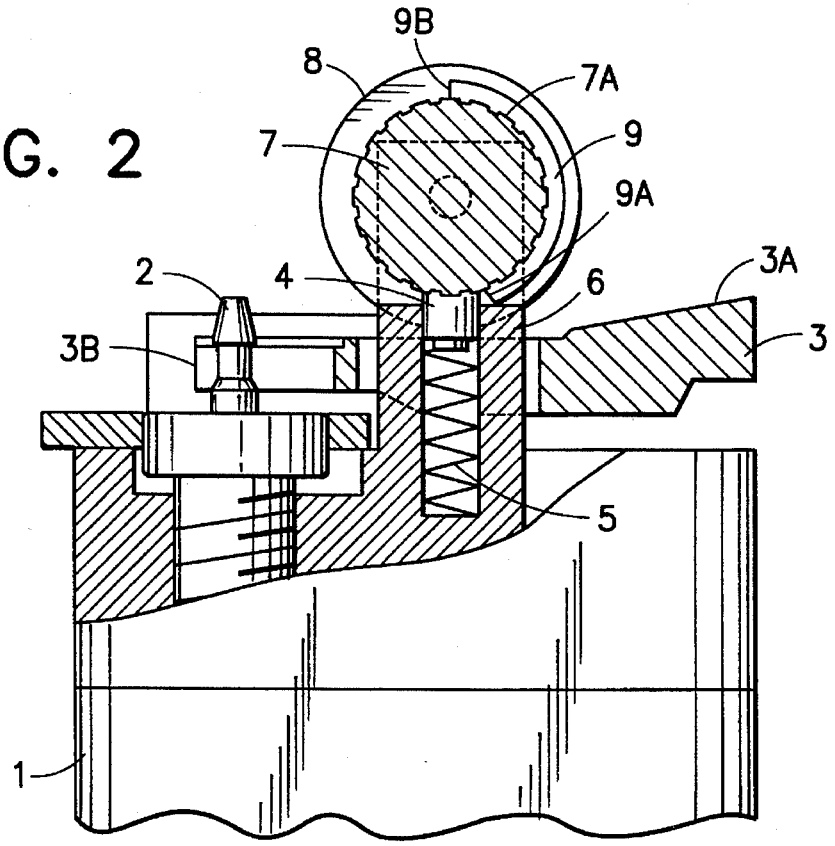

IGNITION SAFETY DEVICE OF GAS LIGHTER

BACKGROUND OF THE INVENTION

1. Field of the Invention

The present invention relates in general to a gas lighter such as a disposable gas lighter and a rechargeable gas lighter and, more particularly, to a structural improvement of an ignition unit of such a gas lighter for prevention of safety accidents, such as a fire, caused by unconscious operation of the gas lighter ignition unit.

2. Description of the Prior Art

In recent times, the gas lighters such as disposable gas lighters and rechargeable gas lighters are widely used for their convenience and low cost. However, these lighters have a problem in that they may cause a safety accident such as a fire particularly when they are carelessly operated such as by a child playing with them.

As well known to those skilled in the art, a conventional gas lighter, that is, a disposable gas lighter or a rechargeable gas lighter, comprises a lighter body including a fuel tank charged with liquidized gas fuel. A gas nozzle is provided on the top section of the lighter body such that it communicates with the fuel tank. This nozzle is pulled upward in order to open a gas outlet of the fuel tank and ejects the gas. In order to pull the nozzle upward, an ignition lever is provided on the top section of the lighter body such that it is levered about its hinged support. A knurled rolling shaft is rotatably mounted on the top section of the lighter body at a position near the distal end of the nozzle. This knurled rolling shaft is provided with thumb operable rolling flanges at its opposed side ends. The rolling shaft and the pair of rolling flanges are assembled into a single body or an ignition roller unit. The rolling shaft is rotated by rotating the rolling flanges by a thumb. Biased upward and toward the knurled rolling shaft by a coil spring at a position just below the rolling shaft is a lighter flint. When the knurled rolling shaft is rotated, the lighter flint elastically frictionally contacting with the knurled outer surface of the rolling shaft is scratched by the rolling shaft and generates sparks which are to fly to the gas ejected from the nozzle and to ignite the gas.

Briefly described, in order to use the conventional gas lighter, the knurled rolling shaft is rotated by rotating the thumb operable rolling flanges so that the lighter flint frictionally contacting with the rolling shaft generates the sparks. At the same time of generation of the sparks, the thumb operable ignition lever is levered down in order to open the nozzle and to eject the gas from the nozzle, thus to ignite the gas by the sparks.

However, the conventional gas lighter has no safety device for prevention of unconscious operations of the ignition unit of the lighter, which operations are caused by, for example, a careless operation or the ignition unit and an operation by a child playing with the lighter. Hence, the conventional gas lighter may cause a safety accident such as a fire.

That is, in the conventional gas lighter having no safety device, there is no limit in rotating the ignition roller unit and ignition of gas. In this regard, the conventional gas lighter may be left as it can be carelessly ignited particularly by a child without limitation and, as a result, may cause a safety accident such as a fire. Otherwise stated, when the child playing with the gas lighter rotates the ignition roller unit while pressing down the ignition lever, the lighter flint inevitably generates the sparks and ignites the gas ejected from the nozzle, thus easily causing safety accident such as a fire.

SUMMARY OF THE INVENTION

It is, therefore, an object of the present invention to provide an ignition safety device of a gas lighter in which the aforementioned problem can be overcome and which assures desired safety by preventing the ignition roller unit from more rotation when the roller unit has been rotated to generate the sparks, thus to prevent ignition of the gas even when a child carelessly operates it while playing with it.

It is another object of the present invention to provide an ignition safety device of a gas lighter which automatically locks the ignition roller unit of the lighter after normal ignition of the lighter, thus to automatically achieve a locking state of the ignition roller unit.

In order to accomplish the above objects, the present invention provides an ignition safety device of a gas lighter, the gas lighter comprising a lighter body including a fuel tank charged with liquidized gas fuel, a gas nozzle communicating with the fuel tank, an ignition lever pulling the nozzle upward in order to open the nozzle, a knurled rolling shaft mounted on a top section of the lighter body at a position near the distal end of the nozzle, a pair of thumb operable rolling flanges mounted on opposed side ends of the rolling shaft for rotating this rolling shaft, and a lighter flint frictionally contacting with the knurled outer surface of the rolling shaft and generating sparks for igniting gas ejected from the nozzle, comprising rotation limit means for prevention of more rotation of the rolling shaft when the rolling shaft has been rotated at a predetermined rotating angle for igniting the gas ejected from the nozzle.

In accordance with embodiments of the present invention, the rotation limit means is provided on the rolling shaft or on the rolling flanges.

In an embodiment, the rotation limit means comprises at least one protrusion provided on the rolling shaft or on the rolling flanges. In this case, the protrusion extends about the outer surface of the rolling shaft to an extent smaller than ½ of the circumference of the rolling shaft, thus to show a semicircular arc shape.

In another embodiment, the rotation limit means comprises a transverse rod which extends from an inside surface of one rolling flange toward the other rolling flange such that it crosses over the rolling shaft between the two rolling flanges. One end of the transverse rod is connected to the inside surface of the one flange but the other end of the rod is spaced apart from the inside surface of the other flange at a predetermined interval.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a top section of a gas lighter provided with an ignition safety device in accordance with a primary embodiment of the present invention;

FIG. 2 is a sectional view of the top section of the gas lighter taken along the section line A—A of FIG. 1;

FIGS. 4A and 4B are sectional views showing an operation of the ignition safety device of FIG. 1, in which:

FIG. 4A shows an ignition roller unit returned to a rotatable state; and

FIG. 4B shows the ignition roller unit having been rotated in order to ignite the gas and restricted from more rotation;

FIGS. 6A and 6B are sectional views taken along the section line A—A of FIG. 5 and showing an operation of the ignition safety device of FIG. 5, in which:

FIG. 6A shows the ignition roller unit returned to a rotatable state; and

FIG. 6B shows the ignition roller unit having been rotated in order to ignite the gas and restricted from more rotation.

DESCRIPTION OF THE PREFERRED EMBODIMENTS

Figure 3:
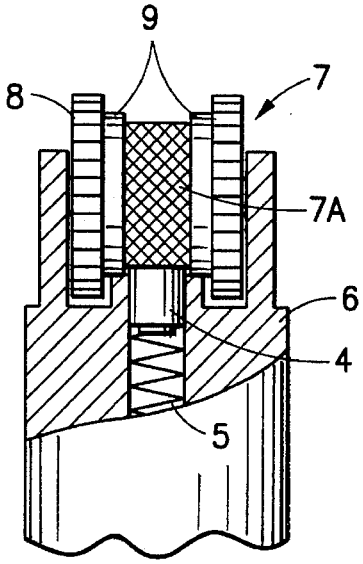
FIG. 3 is a sectional view of the top section of the gas lighter taken along the section line B—B of FIG. 1.

Referring first to FIGS. 1 to 3, there is shown in a perspective view and sectional views a gas lighter provided with an ignition safety device in accordance with a primary embodiment of the present invention. The gas lighter comprises a lighter body 1 including a fuel tank charged with liquidized gas fuel. A gas nozzle 2 is mounted on a top side of the lighter body 1. This nozzle 2 is elastically pulled upward in order to be opened and ejects the gas out of the fuel tank. In order to pull the nozzle 2 upward, an ignition lever 3 is lengthwise placed on the top section of the lighter body 1 such that it is seesawed about its hinged support. The front end 3B of this ignition lever 3 is engaged with the top section of the nozzle 2. A support body 6 is placed on the top section of the lighter body 1. This support body 6 has a center column formed with a center hole. Received in the center hole of the center column of the body 6 is a lighter flint 4 which is also biased upwards by a compression coil spring 5 at its bottom end.

The fuel tank of the lighter body 1 is charged with the liquidized gas fuel which will be ejected through the nozzle 2 to about the front of the lighter flint 4 when the nozzle 2 is pulled upward and opened by the ignition lever 3. As described above, the ignition lever 3 is seesawed about the center column or the flint support column of the support body 6 so that it pulls the nozzle 2 upward in order to open the nozzle 2 and eject the gas out of the fuel tank when its thumb operable plate section 3A is pushed down.

A knurled rolling shaft 7 is rotatably mounted on the support body 6 at a position above the flint support column and near the distal end of the nozzle 2. Since the lighter flint 4 is elastically biased upward by the compression coil spring 5, this lighter flint 4 always comes into frictional contact with the knurled outer surface 7A of the rolling shaft 7.

This knurled rolling shaft 7 is provided at its opposed side ends with thumb operable rolling flanges 8 having a larger diameter. The rolling shaft 7 and the pair of rolling flanges 8 are assembled into a single body or an ignition roller unit. When rotating the rolling flanges 8 by the thumb, the rolling shaft 7 is rotated and scratches the top end of the biased lighter flint 4, thus to generate the sparks which fly to the gas ejected from the nozzle 2 and ignite the gas.

The top end of the flint support column facing the rolling shaft 7 has a width similar to that of the rolling shaft 7.

The ignition safety device of this invention comprises means for limiting the rotation of the rolling shaft 7. In the primary embodiment, the rotation limit means comprises at least one protrusion 9 which partially covers the outer surface of the rolling shaft 7 and come into contact with the top surface of the flint support column of the support body 6 during rotation of the rolling shaft 7, thus to prevent the rolling shaft 7 from more rotation.

A pair of protrusions 9 for limiting the rotation of the rolling shaft 7 are mounted on the opposed inside surfaces of the rolling flanges 8 such that they partially cover opposed sides of the knurled outer surface of the rolling shaft 7.

It should be understood that only one protrusion 9 may be mounted on either inside surface of the rolling flanges 8. In addition, at least one protrusion may be provided on the knurled outer surface of the rolling shaft 7 instead of the inside surface of the rolling flanges 8. In this case, one protrusion may be mounted on either side of the rolling shaft 7 or two protrusions may be mounted on the opposed sides of the rolling shaft 7. The protrusion, mounted on either inside surface of the rolling flanges 8 or provided on the knurled outer surface of the rolling shaft 7, yields the same result as described for the primary embodiment having the two protrusions 9 mounted on opposed inside surfaces of the rolling flanges 8.

As shown in FIG. 2, each of the protrusions 9 mounted on the opposed inside surfaces of the rolling flanges 8 extend about the outer surface of the rolling shaft 7 to an extent smaller than ½ of the circumference of the shaft 7, thus to show a semicircular arc shape. With the semicircular arc protrusions 9, the rotating angle of the rolling shaft 7 is divided into two sections, that is, an ignitable angle section and an anti-ignition angle section.

That is, when the rolling shaft 7 is rotated in order to scratch the lighter flint 4 and generate the sparks, the front ends 9A of the semicircular arc protrusions 9 come into contact with the top surface of the flint support column of the support body 6 and prevent the rolling shaft 7 from more rotation.

Figure 4A:
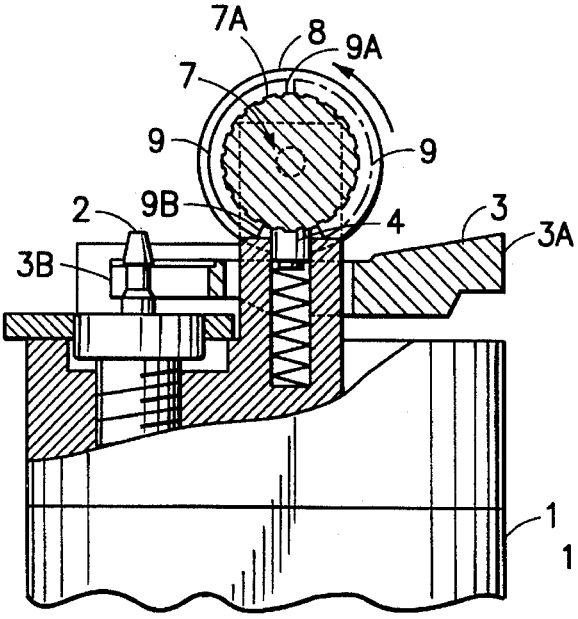
Figure 4B:
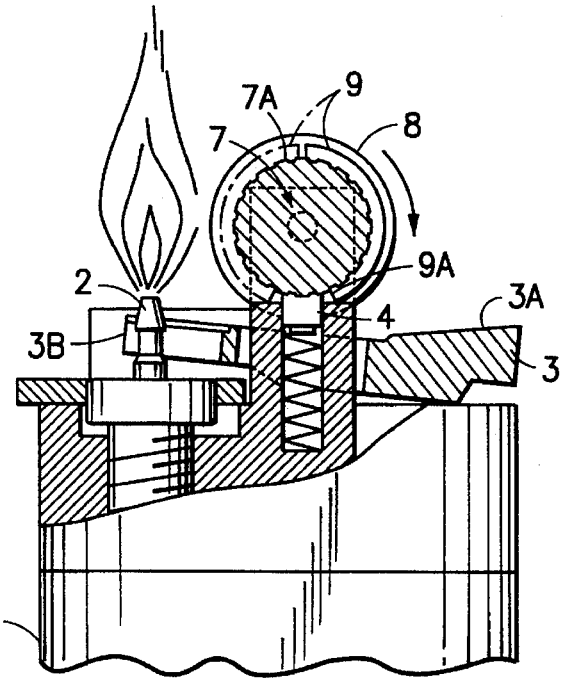

Such an operation of the ignition safety device according to the primary embodiment is represented in detail in FIGS. 4A and 4B. When the front ends 9A of the protrusions 9 come into contact with the top surface of the flint support column as shown in FIGS. 2 and 4B, the protrusions 9 caught by the top surface of the flint support column prevent the rolling shaft 7 from more rotation. Since the rolling shaft 7 at this position can not be rotated any more, it can not scratch the lighter flint 4 and generates no spark flying to the nozzle 2.

In order to return the rolling shaft 7 positioned at the anti-ignition state of FIG. 4B to the ignitable state, this rolling shaft 7 is rotated in reverse direction or counter-clockwise as shown in FIG. 4A until the rear ends 9B of the protrusions 9 come into contact with the top surface of the flint support column of the support body 6. In this ignitable state, the front ends 9A of the protrusions 9 are sufficiently spaced apart from the flint support column so that the rolling shaft 7 can be rotated clockwise while scratching the lighter flint 4. When the rolling shaft 7 in this ignitable state is rotated clockwise by rotating the rolling flanges 8 by the thumb and, at the same time, the thumb operable plate section 3A of the ignition lever 3 is pushed down, the lighter flint 4 is scratched by the knurled outer surface 7A of the shaft 7 and generates the sparks which fly to the gas ejected from the nozzle 2 and ignite the gas.

That is, the clockwise rotation of the rolling shaft 7 makes the knurled outer surface 7A of the shaft 7 scratching the top end of the lighter flint 4, thus to generate the sparks. Since the thumb operable plate section 3A of the lever 3 is pushed down nearly at the same time of rotation of the shaft 7, the nozzle 2 engaged with the front end 3B of the lever 3 is pulled upward and ejects the gas out of the fuel tank of the lighter body 1. Hence, the sparks flying to the gas ejected from the nozzle 2 ignite the gas.

If briefly described the operation of the safety device according to the primary embodiment, when the rolling shaft 7 has been rotated clockwise at a predetermined angle defined by the protrusions 9 and ignited the gas, the front ends 9A of the protrusions 9 come into contact with the top surface of the flint support column and prevent the rolling shaft 7 from more rotation.

The ignitable state of the rotated rolling shaft 7 is achieved by rotating the rolling flanges 8 counterclockwise until the rear ends 9B of the protrusions 9 come into contact with the top surface of the flint support column as shown in FIG. 4A.

Figure 5:
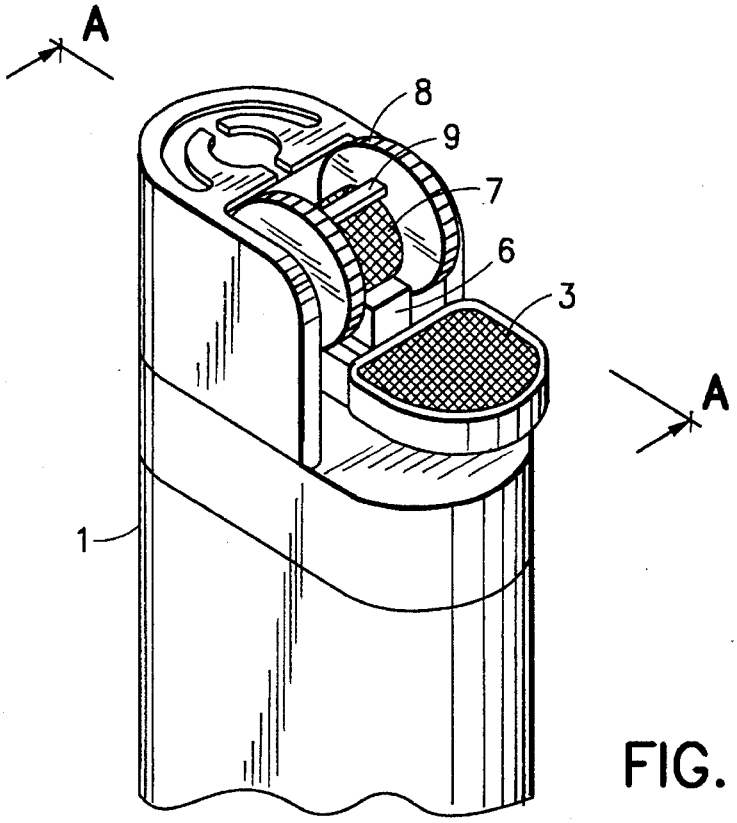
FIG. 5 is a perspective view of a top section of a gas lighter provided with an ignition safety device in accordance with a second embodiment of the present invention.
Figure 6A:
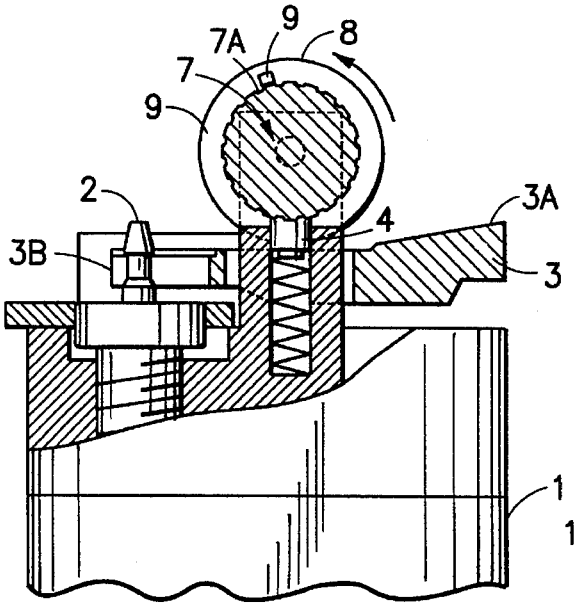
Figure 6B:
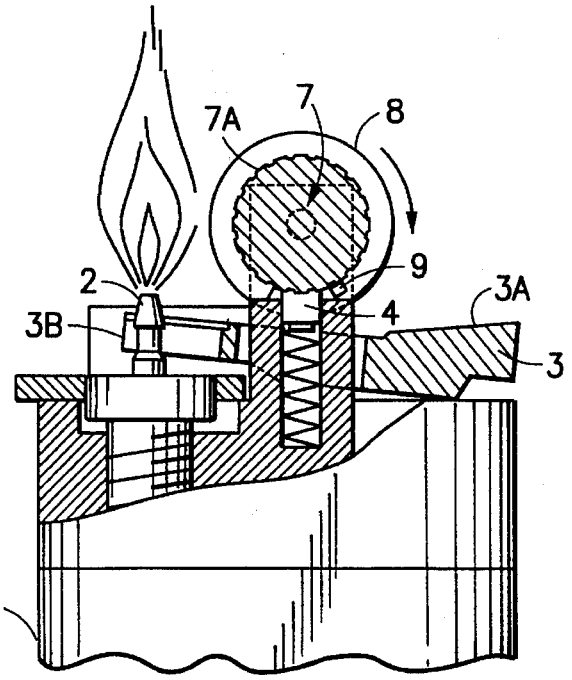

Turning to FIG. 5, there is shown an ignition safety device of a gas lighter in accordance with a second embodiment of the present invention. The operation of the safety device according to this second embodiment is represented in FIGS. 6A and 6B. Elements common to both the primary embodiment and this second embodiment will carry the same numerals and further explanation for the common elements is not deemed necessary.

In this second embodiment, the rotation limit means for limiting the rotation of the rolling shaft 7 within an angular range is embodied by a transverse rod 9' which extends from an inside surface of one rolling flange 8 toward the other rolling flange 8 such that it crosses over the rolling shaft 7 between the opposed rolling flanges 8. That is, one end of the transverse rod 9' is connected to the inside surface of the one flange 8 but the other end of the rod 9' is spaced apart from the inside surface of the other flange 8 at a predetermined interval.

With the structure of the rod 9', of which the one end is connected to the one flange 8 but the other end is spaced apart from the other flange 8, provision of the rotation limit means for the ignition roller unit is simply achieved at the same time of assembling of the ignition roller unit, thus to facilitate the assembling of the roller unit. Conventionally, the assembling of the ignition roller unit is achieved by tightly coupling the two flanges 8 to the opposed side ends of the rolling shaft 7.

With the transverse rod 9' crossing over the rolling shaft 7 and having an enough length for limiting the rotating angle of the rolling shaft 7, the rotating angle of the rolling shaft 7 is divided into two sections, that is, the ignitable angle section and the anti-ignition angle section in the same manner as described for the primary embodiment.

That is, when the rolling shaft 7 has been rotated in order to scratch the lighter flint 4 and generated the sparks, the transverse rod 9' comes into contact with the top surface of the flint support column of the support body 6 and prevent the rolling shaft 7 from more rotation.

Such an operation of the ignition safety device according to the second embodiment is represented in detail in FIGS. 6A and 6B. When the transverse rod 9' comes into contact with the top surface of the flint support column as shown in FIG. 6B, the rod 9' prevents the rolling shaft 7 from more rotation and causes the shaft 7 to generate no spark flying to the nozzle 2.

In order to return the rolling shaft 7 positioned at the anti-ignition state of FIG. 6B to the ignitable state, this rolling shaft 7 is rotated in reverse direction or counterclockwise as shown in FIG. 6A. In this ignitable state, the front edge of the transverse rod 9' is sufficiently spaced apart from the flint support column so that the rolling shaft 7 can be rotated clockwise. When the rolling shaft 7 in this ignitable state is rotated clockwise by rotating the rolling flanges 8 by the thumb and, at the same time, the thumb operable plate section 3A of the ignition lever 3 is pushed down, the lighter flint 4 is scratched by the knurled outer surface 7A of the shaft 7 and generates the sparks which fly to the gas ejected from the nozzle 2 and ignite the gas.

That is, the clockwise rotation of the rolling shaft 7 makes the knurled outer surface 7A of the shaft 7 scratching the top end of the lighter flint 4, thus to generate the sparks. Since the thumb operable plate section 3A of the lever 3 is pushed down nearly at the same time of clockwise rotation of the shaft 7, the nozzle 2 engaged with the front end 3B of the lever 3 is pulled upward and ejects the gas out of the fuel tank of the lighter body 1. Hence, the sparks generated by the flint 4 and flying to the gas ejected from the nozzle 2 ignite the gas.

If briefly described the operation of the safety device according to the second embodiment, when the rolling shaft 7 has been rotated clockwise at a predetermined angle defined by the transverse rod 9' and ignited the gas, the front edge of the rod 9' comes into contact with the top surface of the flint support column and prevent the rolling shaft 7 from more rotation.

Returning of the rotated rolling shaft 7 to the ignitable state is simply achieved by rotating the rolling flanges 8 counterclockwise as shown in FIG. 6A.

As described above, the ignition safety device of a gas lighter in accordance with the present invention has simple structure means for limiting the rotation of the ignition roller unit of the ignition part of the lighter. The rotation limit means comprises at least one protrusion, partially covering the knurled outer surface of the rolling shaft, or a transverse rod crossing over the rolling shaft between the opposed rolling flanges. The safety device thus simply locks and releases the ignition roller unit and can be simply adapted to a conventional gas lighter by changing the ignition roller unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ignition safety device of a gas lighter, said gas lighter comprising a lighter body including a fuel tank, a gas nozzle communicating with said fuel tank, an ignition lever provided on said lighter body for pulling said nozzle upward in order to open said nozzle, a knurled rolling shaft rotatably mounted on said lighter body at a position near the distal end of said nozzle, a pair of thumb operable rolling flanges mounted on opposed side ends of said rolling shaft for rotating this rolling shaft, a lighter flint frictionally contacting with a knurled outer surface of said rolling shaft and generating sparks for igniting gas out of said nozzle, and a support body provided on said lighter body and receiving said lighter flint therein and rotatably supporting both said rolling shaft and said rolling flanges, comprising:

a rotation limiter structured to prevent more rotation of said rolling shaft after the rolling shaft has been rotated at a predetermined rotating angle and has ignited the gas flowing out of said nozzle, wherein said rotation limiter is mounted on said rolling flanges such that the rotation limiter is caught by said support body after said rolling shaft has been rotated at the predetermined rotating angle and has ignited the gas.

2. The ignition safety device according to claim 1, wherein said rotation limiter comprises one protrusion mounted on an inside surface of one of said rolling flanges.

3. The ignition safety device according to claim 1, wherein said rotation limiter comprises a pair of protrusions mounted on opposed inside surfaces of said rolling flanges respectively.

4. The ignition safety device according to claim 1, wherein said rotation limiter extends about said outer surface of the rolling flanges in a semicircular arc shape.

5. An ignition safety device of a gas lighter, said gas lighter comprising a lighter body including a fuel tank, a gas nozzle communicating with said fuel tank, an ignition lever provided on said lighter body for pulling said nozzle upward in order to open said nozzle, a knurled rolling shaft rotatably mounted on said lighter body at a position near the distal end of said nozzle, a pair of thumb operable rolling flanges mounted on opposed side ends of said rolling shaft for rotating this rolling shaft, a lighter flint frictionally contacting with a knurled outer surface of said rolling shaft and generating sparks for igniting gas out of said nozzle, and a support body provided on said lighter body and receiving said lighter flint therein and rotatably supporting both said rolling shaft and said rolling flanges, comprising:

a rotation limiter structured to prevent more rotation of said rolling shaft after the rolling shaft has been rotated at a predetermined rotating angle and has ignited the gas flowing out of said nozzle, wherein said rotation limiter is mounted on an outer surface of said rolling shaft such that the rotation limiter is caught by said support body after said rolling shaft has been rotated at the predetermined rotating angle and has ignited the gas, wherein said rotation limiter extends about said outer surface of the rolling shaft in an arc shape.

6. An ignition safety device of a gas lighter, said gas lighter comprising a lighter body including a fuel tank, a gas nozzle communicating with said fuel tank, an ignition lever provided on said lighter body for pulling said nozzle upward in order to open said nozzle, a knurled rolling shaft rotatably mounted on said lighter body at a position near the distal end of said nozzle, a pair of thumb operable rolling flanges mounted on opposed side ends of said rolling shaft for rotating this rolling shaft, a lighter flint frictionally contacting with a knurled outer surface of said rolling shaft and generating sparks for igniting gas out of said nozzle, and a support body provided on said lighter body and receiving said lighter flint therein and rotatably supporting both said rolling shaft and said rolling flanges, comprising:

a rotation limiter structured to prevent more rotation of said rolling shaft after the rolling shaft has been rotated at a predetermined rotating angle and has ignited the gas flowing out of said nozzle, wherein said rotation limiter comprises a transverse rod extending from an inside surface of one rolling flange toward the other rolling flange such that the transverse rod crosses over said rolling shaft between said rolling flanges.

7. The ignition safety device according to claim 6 wherein one end of said transverse rod being connected to the inside surface of the one flange but the other end of said transverse rod being spaced apart from the inside surface of the outer flange at a predetermined interval.

8. A gas lighter comprising:

a lighter body including a fuel tank:

a gas nozzle communicating with said fuel tank;

an ignition lever provided on said lighter body for pulling said nozzle upward in order to open said nozzle;

a knurled rolling shaft rotatably mounted on said lighter body at a position near the distal end of said nozzle;

a pair of thumb operable rolling flanges mounted on opposed side ends of said rolling shaft for rotating this rolling shaft:

a lighter flint frictionally contacting with a knurled outer surface on said rolling shaft and generating sparks for igniting gas out of said nozzle;

a support body provided on said lighter body and receiving said lighter flint therein and rotatably supporting both said rolling shaft, and said rolling flanges; and rotation limit means for preventing more rotation of said rolling shaft after the rolling shaft has been rotated at a predetermined rotating angle and has ignited the gas flowing out of said nozzle, wherein said rotation limit means is mounted on said rolling flanges such that the rotation limit means is caught by said support body after said rolling shaft has been rotated at the predetermined rotating angle and has ignited the gas.

9. The gas lighter according to claim 8, wherein said rotation limit means comprises one protrusion mounted on an inside surface of one of said rolling flanges.

10. The gas lighter according to claim 8, wherein said rotation limit means comprises a pair of protrusions mounted on opposed inside surfaces of said rolling flanges respectively.

11. The ignition safety device according to claim 8, wherein said rotation limit means extends about said outer surface of the rolling flanges in a semicircular arc shape.

12. A gas lighter comprising:

a lighter body including a fuel tank;

a gas nozzle communicating with said fuel tank;

an ignition lever provided on said lighter body for pulling said nozzle upward in order to open said nozzle;

a knurled rolling shaft rotatably mounted on said lighter body at a position near the distal end of said nozzle;

a pair of thumb operable rolling flanges mounted on opposed side ends of said rolling shaft for rotating this rolling shaft;

a lighter flint frictionally contacting with a knurled outer surface of said rolling shaft and generating sparks for igniting gas out of said nozzle;

a support body provided on said lighter body and receiving said lighter flint therein and rotatably supporting both said rolling shaft and said rolling flanges; and rotation limit means for preventing more rotation of said rolling shaft after the rolling shaft has been rotated at a predetermined rotating angle and ignited the gas flowing out of said nozzle, wherein said rotation limit means is mounted on an outer surface of said rolling shaft such that the rotation limit means is caught by said support body after said rolling shaft has been rotated at the predetermined rotating angle and has ignited the gas, wherein said rotation limit means extends about said outer surface of the rolling shaft in an arc shape.

13. A gas lighter comprising:

a lighter body including a fuel tank;

a gas nozzle communicating with said fuel tank;

an ignition lever provided on said lighter body for pulling said nozzle upward in order to open said nozzle;

a knurled rolling shaft rotatably mounted on said lighter body at a position near the distal end of said nozzle;

a pair of thumb operable rolling flanges mounted on opposed side ends of said rolling shaft for rotating this rolling shaft;

a lighter flint frictionally contacting with a knurled outer surface of said rolling shaft and generating sparks for igniting gas out of said nozzle;

a support body provided on said lighter body and receiving said lighter flint therein and rotatably supporting both said rolling shaft and said rolling flanges; and rotation limit means for preventing more rotation of said rolling shaft when the rolling shaft has been rotated at a predetermined rotating angle add has ignited the gas flowing out of said nozzle, wherein said rotation limit means comprises a transverse rod extending from an inside surface of one rolling flange toward the other rolling flange such that the transverse rod crosses over said rolling shaft between said rolling flanges.

14. The ignition safety device according to claim 13, wherein one end of said transverse rod being connected to the inside surface of the one flange but the other end of said transverse rod being spaced apart from the inside surface of the outer flange at a predetermined interval.

* * * * *